US011248376B2

(12) United States Patent
Lundholm

(10) Patent No.: US 11,248,376 B2
(45) Date of Patent: Feb. 15, 2022

(54) WALL SYSTEM

(71) Applicant: CONCENTUS PROPERTIES AB, Kalix (SE)

(72) Inventor: Anton Lundholm, Kalix (SE)

(73) Assignee: CONCENTUS PROPERTIES AB, Kalix (SE)

( * ) Notice: Subject to any disclaimer, the term of this patent is extended or adjusted under 35 U.S.C. 154(b) by 264 days.

(21) Appl. No.: 16/759,078

(22) PCT Filed: Oct. 26, 2018

(86) PCT No.: PCT/SE2018/051098
§ 371 (c)(1),
(2) Date: Apr. 24, 2020

(87) PCT Pub. No.: WO2019/083438
PCT Pub. Date: May 2, 2019

(65) Prior Publication Data

US 2020/0370297 A1 Nov. 26, 2020

(30) Foreign Application Priority Data

Oct. 27, 2017 (SE) ..... 1751330-0

(51) Int. Cl.
*E04C 2/292* (2006.01)
*E04C 2/08* (2006.01)
(Continued)

(52) U.S. Cl.
CPC ..... *E04C 2/292* (2013.01); *E04C 2/08* (2013.01); *E04B 1/6141* (2013.01); *E04B 2/721* (2013.01);
(Continued)

(58) Field of Classification Search
CPC ..... E04B 1/6141; E04B 1/6158; E04B 1/61; E04B 1/6145; E04B 2/721;
(Continued)

(56) References Cited

U.S. PATENT DOCUMENTS 1,930,345 A * 10/1933 Lewis ..... E04C 2/384 52/792.1
2,039,886 A 5/1936 Cohn
(Continued)

FOREIGN PATENT DOCUMENTS

DE 102015015633 A1 6/2016
KR 101424620 B1 8/2014
(Continued)

*Primary Examiner* — Jessie T Fonseca
(74) *Attorney, Agent, or Firm* — Dilworth & Barrese, LLP

(57) ABSTRACT

A wall system comprising at least one wall module and at least one linking element is provided. Said wall module comprising a substantially rectangular plate (3), said rectangular plate comprising two side edges (5*a*, 5*b*), each comprising a side edge bent configuration (11), wherein said side edge bent configuration comprises a first side bend (13*a*), a second side bend (13*b*) and a third side bend (13*c*), wherein all three side bends (13*a,b,c*) are substantially 180° or 160-200° and are provided along different bending lines being parallel with the side edges (5*a*, 5*b*) of the plate. Said linking element comprises an elongated rectangular plate (33; 33') comprising two side parts (45*a*, 45*b*: 45*a'*, 45*b'*) along a length of said plate (33; 33') and a middle part (47; 47') along the length of said plate between said two side parts, wherein said two side parts (45*a*, 45*b*; 45*a'*, 45*b'*) comprises locking features (43*a*, 43*b*; 201; 43*a'*, 43*b*; 43*a"*; 43*b"*; 43*a'"*; 43*b'"*), wherein the radius of the second side bend (13*b*) of the wall module is provided such that a side part (45*a*, 45*b*; 45*a'*, 45*b'*) of the linking element (31; 31'; 31"; 31'"; 31") can be provided into an opening (17)
(Continued)

between first and third bent side parts (15*a*, 15*c*) of the wall module and during the connection will be passing a third bent side part (15*c*) which finally will lock a side part (45*a*, 45*b*; 45*a'*, 45*b'*) of the linking element (31; 31'; 31"; 31'"; 31'") within the side edge bent configuration (11) of the wall module (1) when a wall module and a linking element have been connected.

19 Claims, 16 Drawing Sheets

(51) Int. Cl.
*E04B 1/61* (2006.01)
*E04B 2/72* (2006.01)
*E04C 2/00* (2006.01)

(52) U.S. Cl.
CPC . *E04B 2001/6195* (2013.01); *E04C 2002/004* (2013.01)

(58) Field of Classification Search
CPC .... E04B 2001/6195; E04C 2/292; E04C 2/08; E04C 2/384; E04C 2/38; E04C 2002/004
See application file for complete search history.

(56) References Cited

U.S. PATENT DOCUMENTS 2,103,407 A * 12/1937 Dean ..... E04B 2/62 52/408
3,074,459 A 1/1963 Pavia
3,390,504 A * 7/1968 Van Elten ..... E04C 2/384 52/588.1
3,742,672 A * 7/1973 Schaeufele ..... E04B 1/54 52/592.1
3,789,567 A * 2/1974 Rae ..... E04B 2/7881 52/584.1
3,992,839 A * 11/1976 La Borde ..... E04B 2/721 52/275
4,186,539 A * 2/1980 Harmon ..... E04B 1/6129 52/580
4,435,935 A * 3/1984 Larrea ..... E04B 1/617 52/461
4,548,015 A * 10/1985 Switzgable ..... E04B 2/30 49/DIG. 1
4,635,422 A * 1/1987 Nowack ..... F16B 5/0064 52/406.1
4,744,185 A * 5/1988 Lamberet ..... E04B 1/6179 52/309.11
5,062,250 A * 11/1991 Buzzella ..... E04D 3/352 52/586.2
2014/0305061 A1* 10/2014 Phillips ..... F41H 5/24 52/438
2016/0053483 A1* 2/2016 Phillips ..... E04H 9/06 52/574

FOREIGN PATENT DOCUMENTS

SE 367978 B 6/1974
WO 02/14616 A1 2/2002
WO WO-2007027698 A2 * 3/2007 ..... F16B 5/0032

* cited by examiner

WALL SYSTEM

TECHNICAL FIELD OF THE INVENTION

The present invention relates to a wall system and a wall segment.

RELATED ART

Wall modules which can be connected to each other and which together make up a larger wall section have been described in for example SE369090. Here a linking element is used to connect the wall modules to each other. Other types of wall modules which are connected to each other without a linking element have also been described. For example in GB599011 one side of each wall module comprises a first interengaging member and the other side comprises a second interengaging member. Said first interengaging member can be engaged with a second interengaging member of another wall module to make up a larger wall segment.

SUMMARY

An object of the invention is to provide an improved wall system with wall modules which can be easily mounted to each other.

This is achieved by a wall system and wall segment according to the description herein.

According to one aspect of the invention a wall system comprising at least one wall module and at least one linking element is provided. Said wall module comprising a substantially rectangular plate. Said rectangular plate comprising two side edges, one top edge and one bottom edge, said side edges each comprising a side edge bent configuration, wherein said side edge bent configuration comprises a first side bend, a second side bend and a third side bend, wherein all three side bends are substantially 180° or 160-200° and are provided along different bending lines being parallel with the side edges of the plate, whereby the side edge bent configuration comprises a first bent side part provided along the side edge of the plate between the first side bend and the second side bend, a second bent side part provided along the side edge of the plate between the second side bend and the third side bend and a third bent side part provided along the side edge of the plate between the third side bend and an open end side or possibly a fourth bent side part of the plate, wherein said first bent side part will be provided between the plate and said second bent side part and wherein said third bent side part is provided in between said first and said second bent side parts and which third bent side part is smaller than both the first and the second bent side parts. Said linking element comprises an elongated rectangular plate (33; 33') comprising two side parts (45*a*, 45*b*: 45*a*', 45*b*') along a length of said plate (33; 33') and a middle part (47; 47') along the length of said plate between said two side parts, wherein said two side parts (45*a*, 45*b*; 45*a*', 45*b*') comprises locking features (43*a*, 43*b*; 201), wherein the radius of the second side bend (13*b*) of the wall module is provided such that a side part (45*a*, 45*b*; 45*a*', 45*b*') of the linking element (31; 31') can be provided into an opening (17) between the first and third bent side parts (15*a*, 15*c*) of the wall module and during the connection will be passing the third bent side part (15*c*) which finally will lock a side part (45*a*, 45*b*; 45*a*', 45*b*') of the linking element (31; 31') within the side edge bent configuration (11) of the wall module (1) when a wall module and a linking element have been connected.

According to another aspect of the invention a wall segment is provided comprising a wall system as defined above comprising at least two wall modules connected by at least one linking element.

Hereby a wall system is provided comprising a wall module which can be built from a rectangular plate by just bending the side edges of the plate. The side edges of the plate are bent three times each for providing a side edge bent configuration with an opening along its side edges for receiving a linking element when two wall modules are connected. This provides for an easily built wall module with connection capabilities. The locking features of the linking element and its cooperation with the third bent side part in the side edge bent configuration of the wall module provides for a stable wall construction.

In one embodiment of the invention a radius of the second side bend is provided such that an opening into the side edge bent configuration is provided between the first and third bent side parts for receiving a linking element.

A further object of the invention is to provide a wall system with wall modules which can be easily mounted to a floor strip.

This is achieved by a wall module, wherein said bottom edge of said rectangular plate comprises a bottom edge bent configuration, wherein said bottom edge bent configuration comprises a first bottom bend and a second bottom bend, wherein the first and second bottom bends are substantially 180° and are provided along different bending lines being parallel with the bottom edge of the plate, whereby the bottom edge bent configuration comprises a first bent bottom part provided along the bottom edge of the plate between the first bottom bend and the second bottom bend, a second bent bottom part provided along the bottom edge of the plate between the second bottom bend and either a third bottom bend or an open bottom end side of the panel, wherein the first bent bottom part will be provided between the plate and the second bent bottom part.

Hereby a wall module is provided which also has a bottom edge bent configuration along its bottom edge and the wall module can be provided mounted to a floor strip. Hereby an easy mounting of the wall module to a floor is achieved and furthermore a water proof mounting can easily be assured.

In one embodiment of the invention a radius of the second bottom bend is provided such that an opening into the bottom edge bent configuration is provided between the first and second bent bottom parts for receiving a floor strip.

In one embodiment of the invention said bottom edge bent configuration comprises also a third bottom bend being substantially 180° and being provided along a bending line which is parallel with the bottom edge of the plate and hereby said bottom edge bent configuration further comprises a third bent bottom part provided along the bottom edge of the plate between the third bottom bend and an open bottom end side of the panel, which third bent bottom part being provided in between said first and said second bent bottom parts and which third bent bottom part is smaller than both the first and the second bent bottom parts.

In one embodiment of the invention a radius of the first bottom bend is provided such that the first, second and third bend side parts of the side edges are provided in between a plane in which the first bent bottom part is provided and a plane in which a center part of the plate is provided. Hereby a linking element which will link two wall modules to each other will always be provided inside a floor strip when the wall modules also are mounted to such a floor strip. If the linking element is provided along the whole length of the wall module and hereby also down to the floor inside the floor strip water cannot pass outside. Hereby a water proof mounting is achieved.

In one embodiment of the invention a width of the middle part of the linking element corresponds substantially to a width of the third bent side part of the wall module times two.

In one embodiment of the invention said locking features extend from a plane of the elongated rectangular plate of the linking element, which locking features will be locked inside the side edge bent configuration by the third bent side part when a wall module and a linking element have been connected.

In one embodiment of the invention a length of said linking element corresponds substantially to a length of the wall module.

In one embodiment of the invention said locking features are double folds of the plate along its side edges hereby providing two side parts of the linking element comprising double folded plate and a middle part of the linking element comprising a single layer of the plate.

DETAILED DESCRIPTION OF EMBODIMENTS

Figure 1:
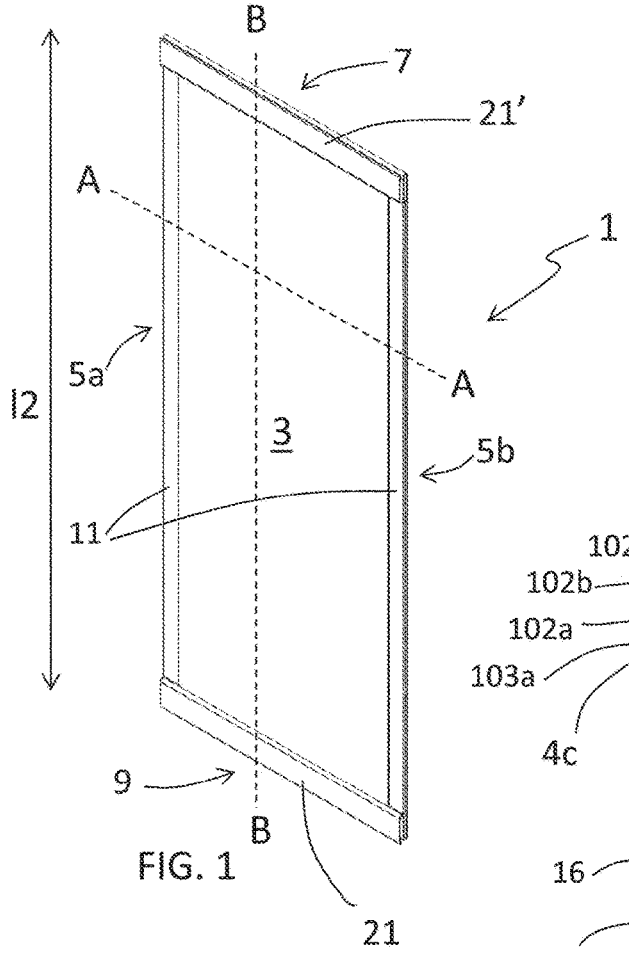
FIG. 1 is a perspective view of a wall module according to one embodiment of the invention.
Figure 2:
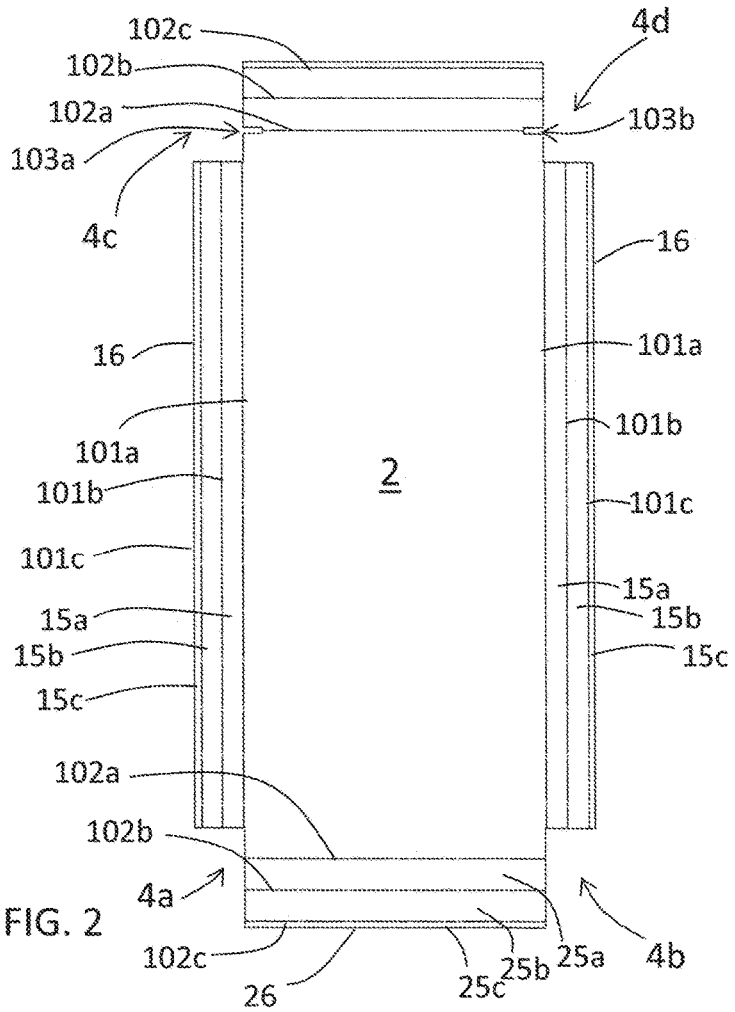
FIG. 2 shows a blank of a wall module according to one embodiment of the invention before edges of the wall module have been bent.

FIG. 1 is a perspective view of a wall module 1 according to one embodiment of the invention. FIG. 2 shows a blank 2 of the wall module 1 shown in FIG. 1 before edges of the wall module 1 have been bent. Side edge bending lines 101*a*, 101*b*, 101*c* along each side edge of the blank and top and bottom bending lines 102*a*, 102*b*, 102*c* along a top and a bottom of the blank are shown in the blank 2. Side edges and top and bottom edges of the blank will be bent along these bending lines for providing bent configurations of the wall module as will be further described below. Corners 4*a*, 4*b*, 4*c*, 4*d* have been cut out from the blank 2 such that both side edges and top and bottom edges of the wall module can be bent. In another embodiment of the invention only the two side edges and a bottom edge will be bent, i.e. not the top edge. In this embodiment only two corners 4*a*, 4*b* need to be cut out.

In the blank 2 according to the embodiment shown in FIG. 2 two recesses 103*a*, 103*b* are shown in a top edge of the blank. Material has been cut out from outer edges of the innermost top bending line 102*a*. These recesses 103*a*, 103*b* can be used for removing a linking element 31 from two connected wall modules.

According to the invention a wall module 1 comprising a substantially rectangular plate 3 is provided. Said plate can be made from a metal such as a sheet metal for example with a thickness from 0.3 to 2.5 mm. Other thicknesses may also be possible. The material of the plate should be possible to bend. Furthermore some degree of resilience in the bending is suitable such that a linking element can be forced into a side opening in a side edge bent configuration of the wall module as will be further described below.

Figure 3A:
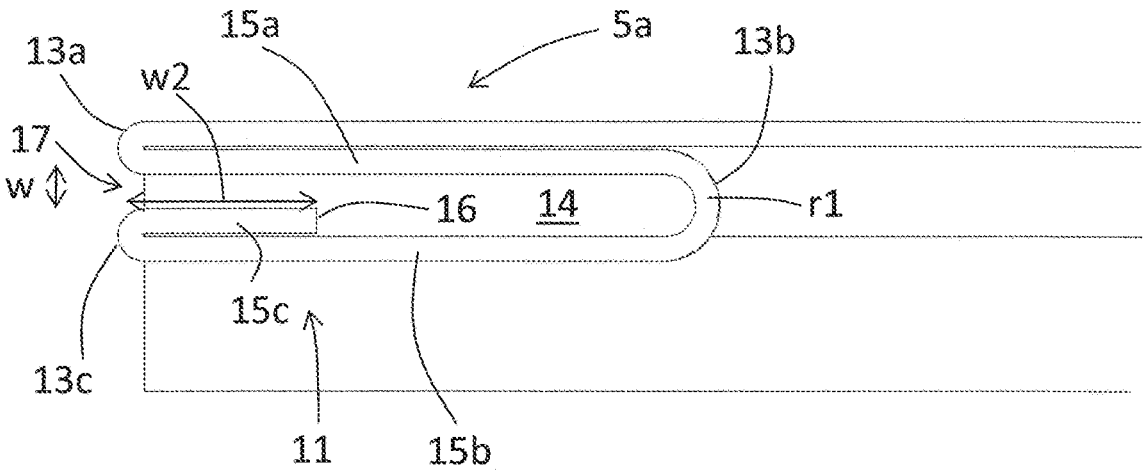
FIG. 3*a* is a cross section along line A:A in FIG. 1 of the wall module showing a side edge bent configuration of one of the sides edges.

The rectangular plate 3 of the wall module 1 comprises two side edges 5*a*, 5*b*, one top edge 7 and one bottom edge 9. According to the invention said side edges 5*a*, 5*b* comprise each a side edge bent configuration 11. FIG. 3*a* is a cross section along the line A:A through the wall module 1 of FIG. 1 showing one of the side edges 5*a* of the wall module 1. In this view the side edge bent configuration 11 which is present in both side edges 5*a*, 5*b* can be seen. The side edge bent configuration 11 comprises a first side bend 13*a*, a second side bend 13*b* and a third side bend 13*c*, wherein all three side bends 13*a,b,c* are substantially 180° and they are provided along different bending lines 101*a*, 101*b*, 101*c* being parallel with the side edges 5*a*, 5*b* of the plate 3. A fourth side bend could as well be provided in some embodiments for example for compensating a possible inexactness of a size of the plate 3. This can be seen in FIG. 3*b*. These side edge bending lines 101*a*, 101*b*, 101*c* can be seen in FIG. 2 where the blank is shown. The bends may not always be exactly 180°. Small deviations from 180° should also be covered by this invention. Even larger deviations from 180° should be covered by the invention, such as 160-200°. A larger bend than 180° of the second side bend 13*b* and a smaller bend than 180° of the third side bend 13*c* can in some cases be advantageous for improving a locking of a linking element inside the side edge bent configuration which will be further described below. Furthermore the side edge bent configuration 11 comprises a first bent side part 15*a* provided along the side edge 5*a*, 5*b* of the plate 3 between the first side bend 13*a* and the second side bend 13*b*, a second bent side part 15*b* provided along the side edge of the plate between the second side bend 13*b* and the third side bend 13*c* and a third bent side part 15*c* provided along the side edge of the plate between the third side bend 13*c* and an open end side 16 of the plate 3. If a fourth side bend is provided a fourth bent side part will also be provided and the third bent side part 15*c* will then be provided between the third side bend 13*c* and a fourth side bend. The first, second and third bent side parts 15*a,b,c* are indicated also in the blank in FIG. 2 even though they have not yet been bent in the blank. The open end side 16 is also shown in the blank. The second bent side part 15*b* is overlying said first bent side part 15*a* in the side edge bent configuration 11 and the third bent side part 15*c* is provided in between said first and said second bent side parts 15*a*, 15*b* in the side edge bent configuration 11. Furthermore the third bent side part 15*c* is smaller than both the first and the second bent side parts 15*a*, 15*b*. Hereby there will be an open space 14 provided inside the third bent side part 15*c* and between the first and second bent side parts 15*a*, 15*b*. In this open space 14 side parts 45*a*, 45*b* of a linking element 31 will be provided when two modules are connected which will be further described below. A radius r1 of the second side bend 13*b* is provided such that an opening 17 is provided between the first and third bent side parts 15*a*, 15*c* for receiving a linking element 31 into the side edge bent configuration 11. The radius r1 of the second side bend 13*b* can be provided such that a width w of the opening 17 between the first and third bent side parts 15*a*, 15*c* is between for example one and two times a thickness of a plate from which the linking element 31 is made. However the width of the opening 17 may be even smaller. If there is some flexibility in the second side bend 13*b* a linking element 31 can be forced into the opening 17 of the side edge bent configuration 11.

Figure 3B:
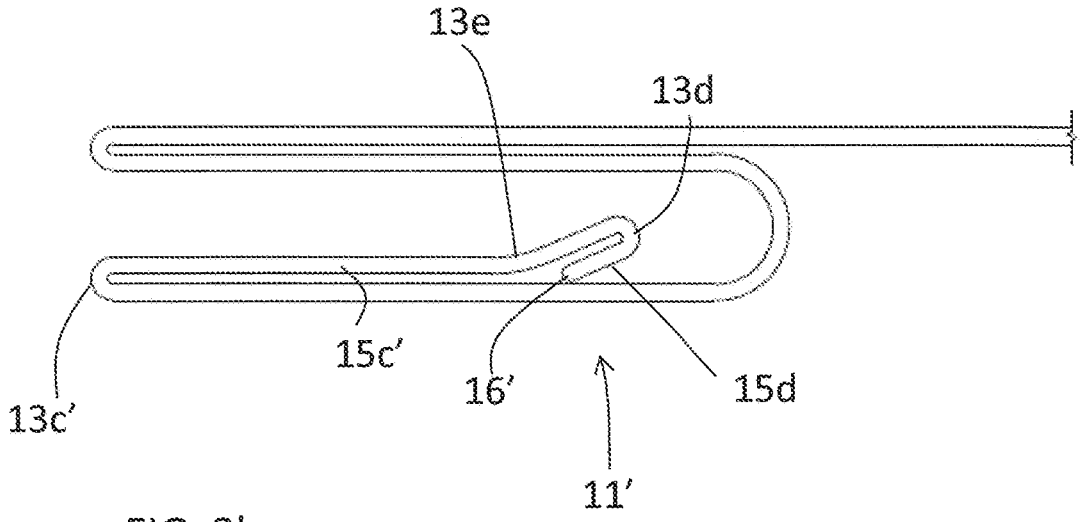
FIG. 3*b* is a cross section of a side edge bent configuration of a wall module according to another embodiment of the invention.

FIG. 3*b* is a cross section of a side edge bent configuration 11' of a wall module according to another embodiment of the invention. Most of the details are the same as in the embodiment shown in FIG. 3*a* and will not be described again but in this embodiment a fourth side bend 13*d* being substantially 180 degrees is provided. Hereby also a fourth bent side part 15*d* is provided between the third bent side part 15*c'* and the open end side 16'. Furthermore an optional smaller intermediate bend 13*e* is provided in this embodiment. This intermediate bend 13*e* is for example less than 50 degrees and provided between the third side bend 13*c'* and the fourth side bend 13*d* only for allowing an additional clamping of a linking element.

When two wall modules 1 should be connected a linking element 31 which will be further described below in relation to FIGS. 6*a*-6*j* is used and a linking element side part is inserted into the opening 17 of the side edge bent configuration. This is described further below.

Figure 4A:
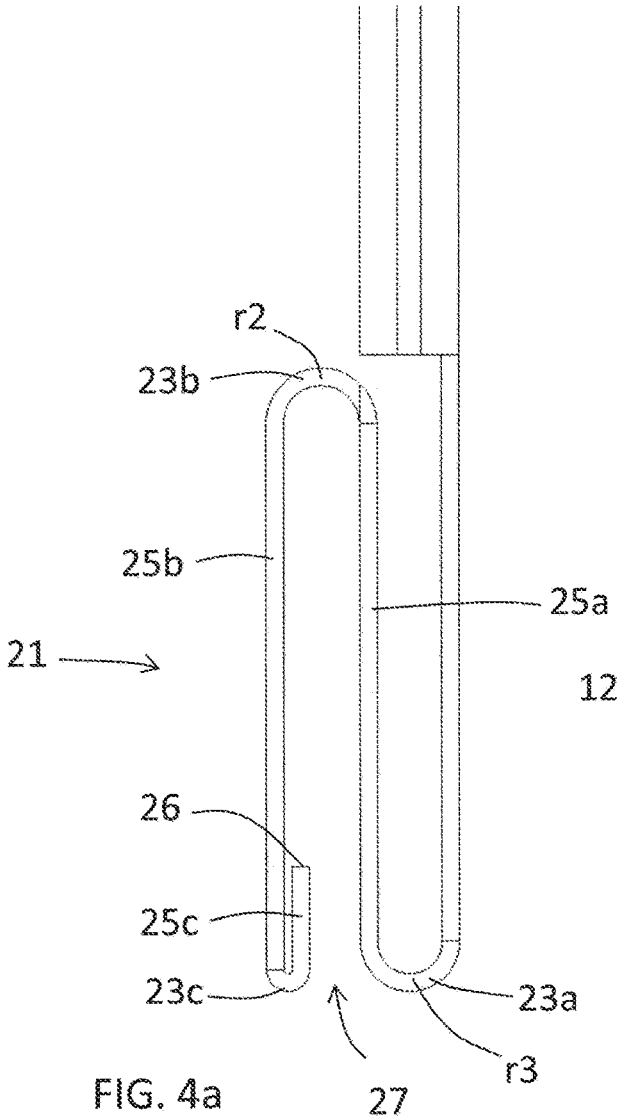
FIG. 4*a* is a cross section along line B:B in FIG. 1 showing a bottom edge bent configuration of a bottom part of a wall module according to one embodiment of the invention.
Figure 4B:
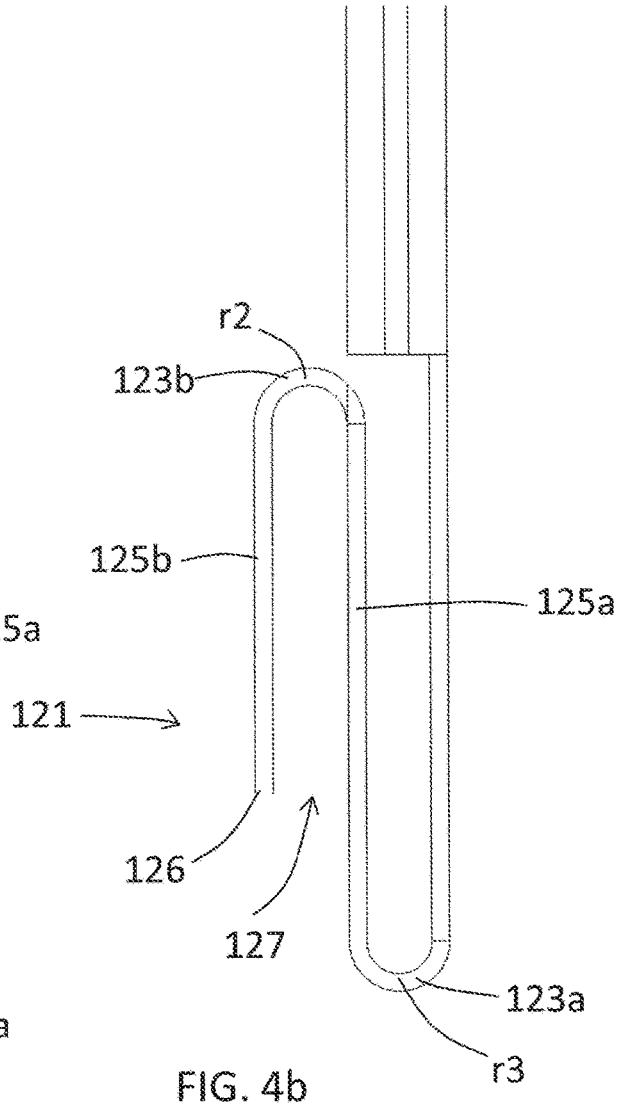
FIG. 4*b* is a cross section showing a bottom edge bent configuration of a bottom part of a wall module according to another embodiment of the invention.

FIG. 4*a* is a cross section through the wall module along the line B:B in FIG. 1 showing a bottom part of the wall module 1. In this embodiment of the invention the bottom edge 9 of the plate 3 comprises a bottom edge bent configuration 21 which is similar to the side edge bent configuration 11. In FIG. 4*b* an alternative bottom edge bent configuration 121 is shown. However in another embodiment of the invention the bottom edge 9 of the plate 3 can be provided without a bent configuration. In the embodiment shown in FIGS. 1 and 2 also the top edge 7 comprises a bent configuration 21'. However this is mainly because of symmetry reasons. The invention can as well be provided without a bent configuration of the top edge 7.

The bottom edge bent configuration 21 comprises in this embodiment a first bottom bend 23*a*, a second bottom bend 23*b* and a third bottom bend 23*c*, wherein the first, second and third bottom bends 23*a,b,c* all are substantially 180° and are provided along different bending lines 102*a*, 102*b*, 102*c* being parallel with the bottom edge 9 of the plate 3. These bending lines 102*a,b,c* are shown in the blank in FIG. 2. The bends may not be exactly 180° which is covered by the invention. Hereby the bottom edge bent configuration 21 comprises a first bent bottom part 25*a* provided along the bottom edge 9 of the plate 3 between the first bottom bend 23*a* and the second bottom bend 23*b*, a second bent bottom part 25*b* provided along the bottom edge of the plate between the second bottom bend 23*b* and the third bottom bend 23*c* and a third bent bottom part 25*c* provided between the third bottom bend 23*c* and an open bottom end side 26 of the panel. In the embodiment shown in FIGS. 1,2 and 4*a* the bottom edge bent configuration 21 is similar to the side edge bent configuration 11 shown in FIG. 3*a* and comprises hereby three bottom bends 23*a,b,c* and three bent bottom parts 25*a,b,c*. The third bent bottom part 25*c* is provided in between said first and said second bent bottom parts 25*a*, 25*b* and the third bent bottom part 25*c* is smaller than both the first and the second bent bottom parts 25*a*, 25*b*. The three bent bottom parts 25*a,b,c* are indicated in the blank of FIG. 2 even though they have not been bent yet in the blank.

FIG. 4*b* shows a bottom edge bent configuration 121 according to another embodiment of the invention where only two bent bottom parts 125*a*, 125*b* and two bottom bends 123*a*, 123*b* are provided. Hereby the second bent bottom part 125*b* is provided between the second bottom bend 123*b* and an open bottom end side 126 of the panel.

The second bent bottom part 25*b*; 125*b* is overlying said first bent bottom part 25*a*; 125*a* in the bottom edge bent configuration 21; 121 and a radius r2 of the second bottom bend 23*b*; 123*b* is provided such that an opening 27; 127 is provided between the first and second bent bottom parts 25*a*, 25*b*; 125*a*, 125*b* (possibly with a third bent bottom part 25*c* in between as in FIG. 4*a*) for receiving a floor strip. In these embodiments of the invention where also the bottom edge 9 of the wall module 1 comprises a bent configuration 21; 121 as described above the wall module 1 can be mounted to a floor strip, i.e. a strip provided in a perpendicular relationship to a floor. Hereby an easy way of mounting the wall module to a floor is achieved. Furthermore a convenient way of providing a water proof mounting of wall modules can be provided as will be further described below. If three bottom bends 23*a, b, c* are provided and hereby also a third bent bottom part 25*c* as shown in FIG. 4*a* the third bent bottom part 25*c* may help in providing a robust and stable mounting of the wall module 1 to the floor strip. If the floor strip comprises some kind of locking detail at a certain distance from the floor level the wall module can be forced down onto the floor strip until the third bent bottom part 25*c* has passed such a locking detail. If the material of the plate 3 and the bends of the bottom edge bent configuration 21 provide some resilience to the bottom edge bent configuration 21 the third bent bottom part 25*c* will provide a locking feature by locking the wall module 1 in place when the locking detail has been passed. However, in another embodiment of the invention (as shown in FIG. 4*b*) only two bottom bends 123*a, b* are provided and no locking feature needs to be provided. The wall module 1 will then be provided hanging over the floor strip when mounted. A water proof construction can still be achieved in a convenient way which will be further described below.

In the embodiment of the invention as shown in FIGS. 1 and 4*a* and 4*b* a radius r3 of the first bottom bend 23*a*; 123*a* is provided such that the first, second and third bent side parts 15*a*, 15*b*, 15*c* of the side edges 5*a*, 5*b* are provided in between a plane in which the first bent bottom part 25*a*; 125*a* is provided and a plane in which a center part of the plate 3 is provided. In other words the side edge bent configuration 11 will be provided closer to the plane of a center part of the plate 3 than the bottom edge bent configuration 21; 121. Hereby a linking element which will link two wall modules to each other will always be provided inside a floor strip when the wall modules also are mounted to such a floor strip. If the linking element 31 is provided along the whole length of the wall module and hereby also down to the floor inside the floor strip water cannot pass outside. Hereby a water proof mounting is achieved.

Figure 5:
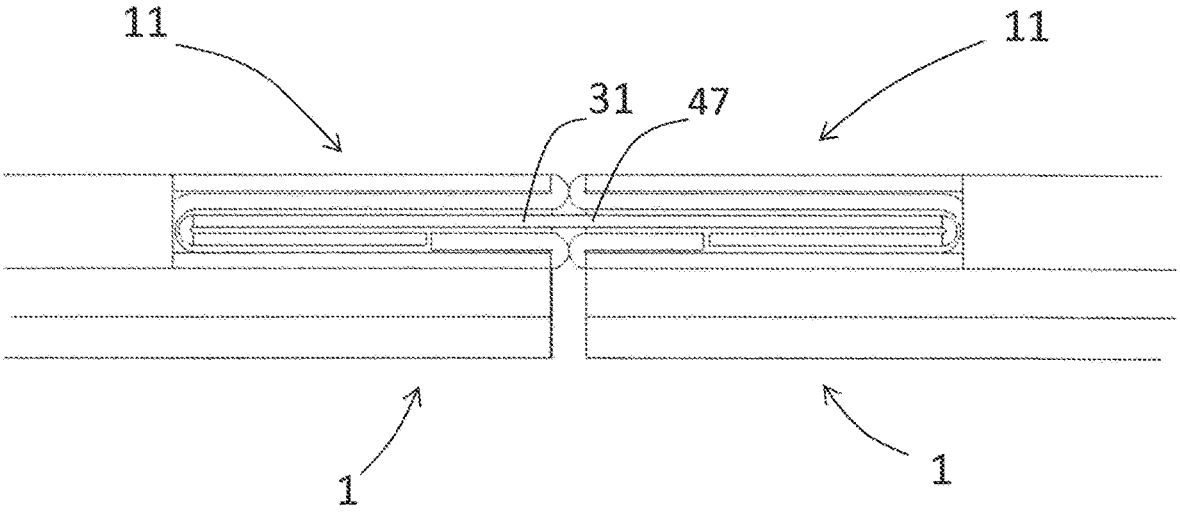
FIG. 5 is a cross section top view of two connected wall modules according to one embodiment of the invention.

FIG. 5 is a cross section top view of two connected wall modules 1 according to one embodiment of the invention. In this view the side edge bent configuration 11 of the two wall modules 1 can be seen and furthermore a linking element 31 according to the invention. The linking element 31 is inserted into the openings 17 of the side edge bent configurations 11 to link the two wall modules together.

According to one aspect of the invention a wall system is provided, which wall system comprises at least one wall module 1 and at least one linking element 31; 31'. According to another aspect of the invention a wall segment is provided comprising at least two wall modules 1 which are linked to each other by a linking element 31; 31'.

Figure 6A:
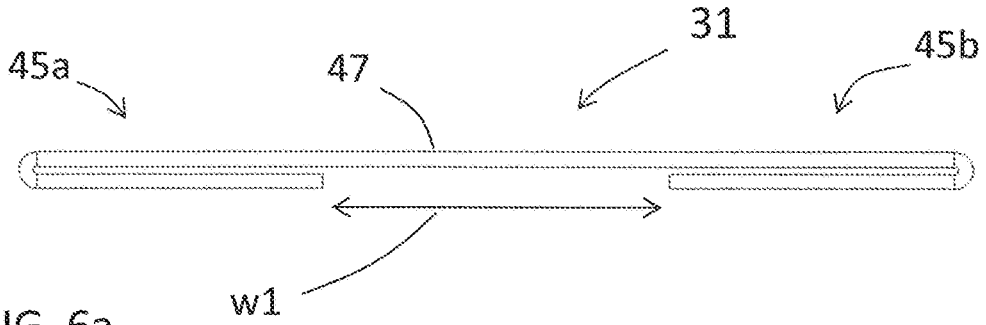
FIGS. 6*a* and 6*b* show a linking element according to one embodiment of the invention.
Figure 6B:
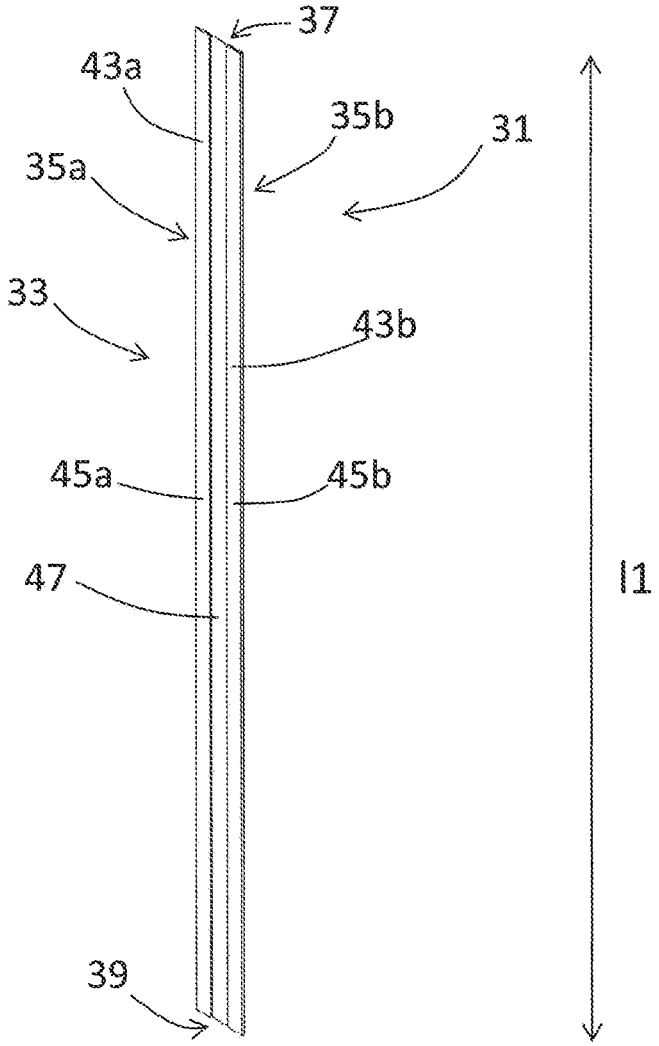

FIGS. 6*a* and 6*b* show a linking element 31 in a top view and in a perspective view according to one embodiment of the invention. The linking element 31 comprises an elongated rectangular plate 33 having two linking element side edges 35*a*, 35*b*, one linking element top edge 37 and one linking element bottom edge 39. The linking element 31 comprises further locking features 43*a*, 43*b* which extend from a plane of the elongated rectangular plate 33 of the linking element 31. The locking features will be locked inside the side edge bent configuration 11 by the third bent side part 15*c* when a wall module and a linking element have been connected. The locking features 43*a*, 43*b* are in this embodiment double folds of the plate 33 along its side edges 35*a*, 35*b*. However other alternatives for locking features are possible and some examples will be described below in relation to FIGS. 6*c*-6*j*.

Two side parts 45*a*, 45*b* of the linking element 31 comprising double folded plate and a middle part 47 of the linking element 31 comprising a single layer of the plate are hereby provided. A width w1 of the middle part 47 of the linking element 31 corresponds substantially to a width w2 of the third bent side part 15*c* of the wall module 1 times two. Hereby, when two wall modules 1 are linked together by a linking element 31 as shown in FIG. 5 the middle part 47 of the linking element 31 will be positioned in the openings 17 of the side edge bent configurations 11 of the two wall modules between the third bent side part 15*c* and the first bent side part 15*a*. The side parts 45*a*, 45*b* of the linking element 31 will be positioned further into the side edge bent configuration 11, i.e. in the open space 14 as shown in FIGS. 3*a* and 3*b*. Hereby the third bent side part 15*c* will lock the side parts/locking features 45*a*, 45*b*, 43*a*, 43*b* of the linking element 31 inside the side edge bent configuration 11 and a stable connection of the two wall modules 1 is achieved.

A length l1 of the linking element 31 corresponds substantially to a length l2 of the wall module 1. Hereby a stable connection of the two wall modules 1 is achieved and furthermore the linking element 31 will be provided all the way down, passing an upper edge of a floor strip to which the wall modules can be mounted as described above. Hereby a water proof mounting can be assured.

In an alternative embodiment of the invention the linking element can instead be divided into smaller linking parts, i.e. each linking part is not at all as long as the whole wall module as described above. In such embodiment a number of smaller linking parts can be used for linking two wall modules, for example one upper linking element, one lower and one in the middle.

The radius r1 of the second side bend 13*b* of the wall module 1 is provided such that a side part 45*a*, 45*b* of the linking element 31 can be provided into the opening 17 between the first and third bent side parts 15*a*, 15*c* of the wall module and during the connection will be passing the third bent side part 15*c* which finally will lock a side part 45*a*, 45*b* of the linking element 31 within the side edge bent configuration 11 of the wall module 1 when a wall module 1 and a linking element 31 have been connected. Hereby the side part 45*a*, 45*b* of the linking element 31 will be provided between the first and second bent side parts 15*a*, 15*b* in a space 14 provided inside the third bent side part 15*c*.

Figure 6C:
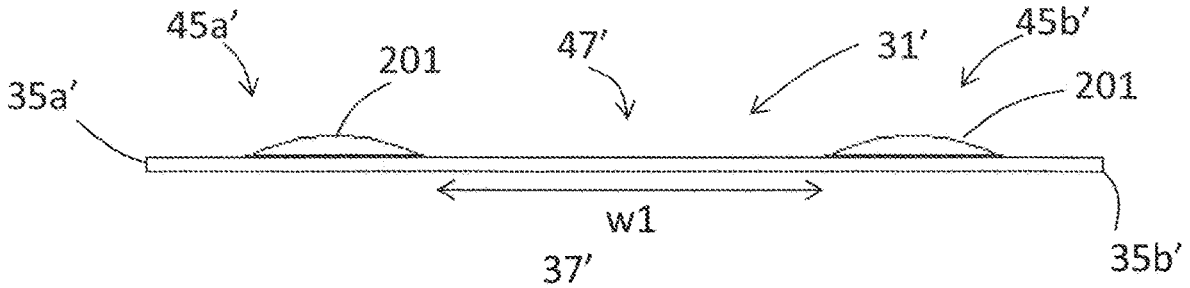
FIGS. 6*c* and 6*d* show a linking element according to another embodiment of the invention.
Figure 6D:
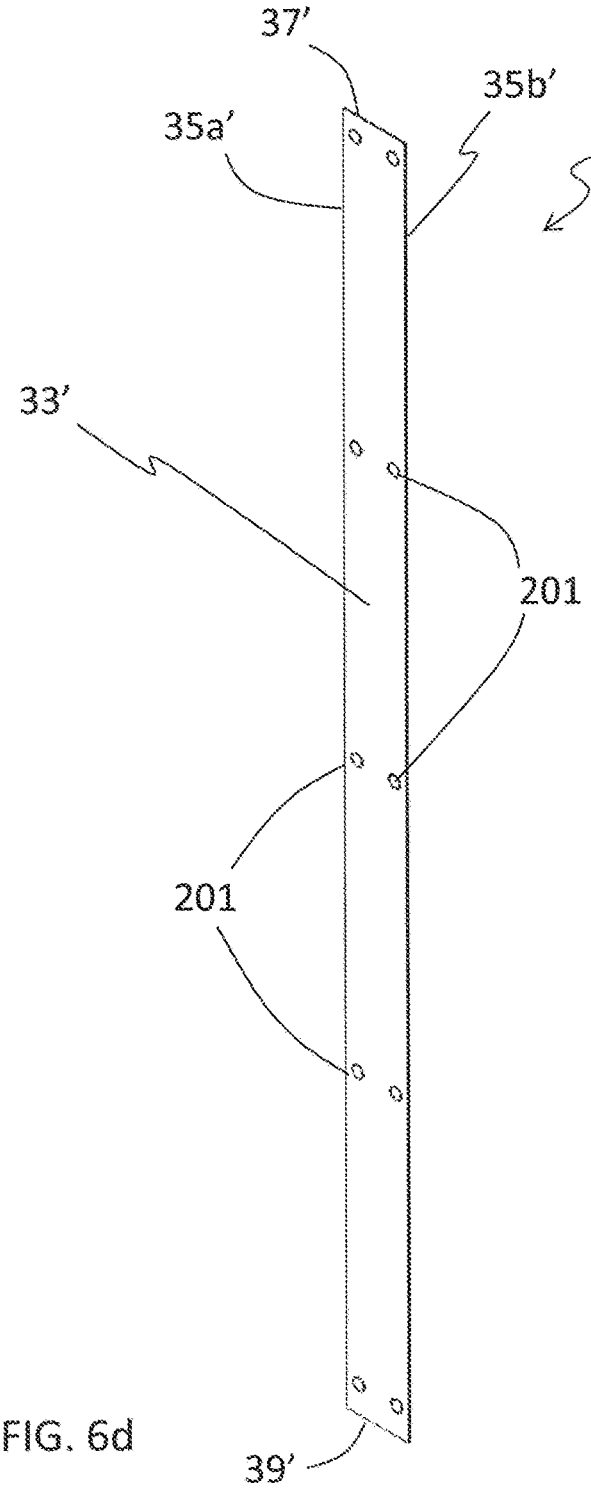

FIGS. 6*c* and 6*d* show a linking element 31' according to another embodiment of the invention. FIG. 6*c* is a top view of the linking element 31' and FIG. 6*d* is a perspective view of the linking element 31'. The linking element 31' according to this embodiment comprises an elongated rectangular plate 33' having two linking element side edges 35*a*', 35*b*', one linking element top edge 37' and one linking element bottom edge 39'. The linking element 31' comprises two side parts 45*a*', 45*b*' having locking features 201 and a middle part 47' between said two side parts, whereby a width w1 of the middle part 47' corresponds substantially to a width w2 of the third bent side part 15*c* of the wall module 1 times two. The locking features 201 are in this embodiment of the linking element 31' provided at a suitable distance from the linking element side edges 35*a*', 35*b*' and are protrusions 201 formed in the plate for acting as locking parts. A suitable distance is chosen to correspond to the design of the side edge bent configurations 11 of the wall module 1, i.e. the protrusions 201 should be provided inside the third bent part 15*c* of the side edge bent configuration 11 when the linking element 31' is connecting two wall modules 1. Protrusions 201 are hereby formed along the two side edges of the linking element 31'. The number of protrusions 201 can be varied. For example one protrusion 201 can be provided for each of the two sides of the linking element close to the linking element bottom edge 39' and one protrusion 201 can be provided for each of the two sides of the linking element close to the linking element top edge 37'. In another embodiment additional protrusions 201 can be provided with suitable spacing in between these upper and lower protrusions, such as shown in FIG. 6*d*. In another embodiment the locking feature is instead provided as a groove extending from a plane of the plate 33'. Said groove could be provided along the whole length of the linking element.

Figure 6E:
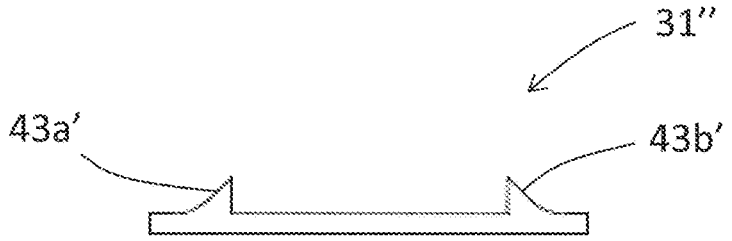
FIGS. 6*e* and 6*f* show a linking element according to another embodiment of the invention.
Figure 6F:
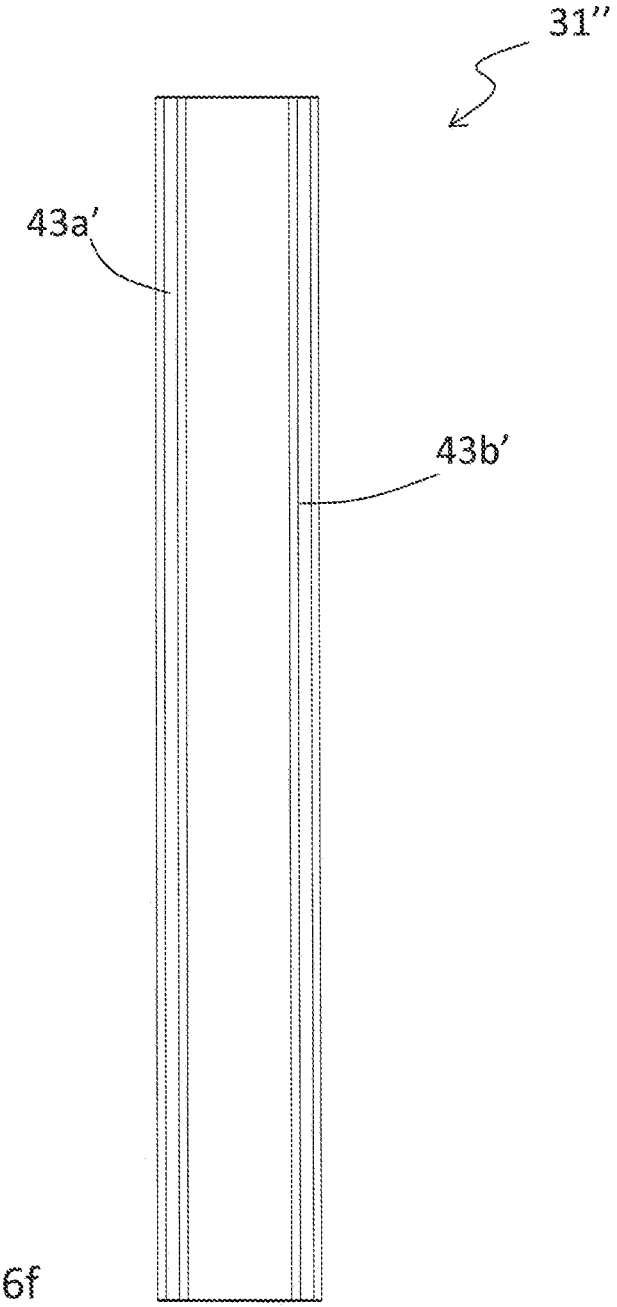

FIGS. 6*e* and 6*f* show a linking element 31" according to another embodiment of the invention. FIG. 6*e* is a top view of the linking element 31" and FIG. 6*f* is a front view of the linking element 31". The design and function correspond to the two previously described linking elements 31, 31' in relation to FIGS. 6*a*-6*d*. Locking features 43*a*', 43*b*' are in this embodiment provided as one extending groove along each side of the linking element 31". The groove can be formed as a hook for improving a clamping effect inside the bent configuration 11 of the wall modules 1.

Figure 6G:
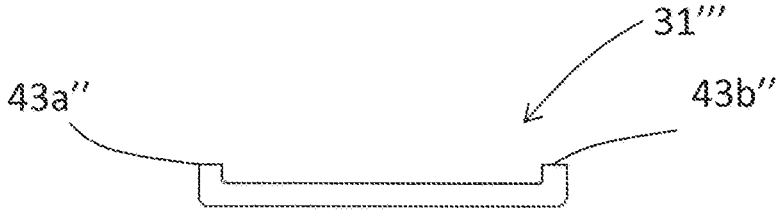
FIGS. 6*g* and 6*h* show a linking element according to another embodiment of the invention.
Figure 6H:
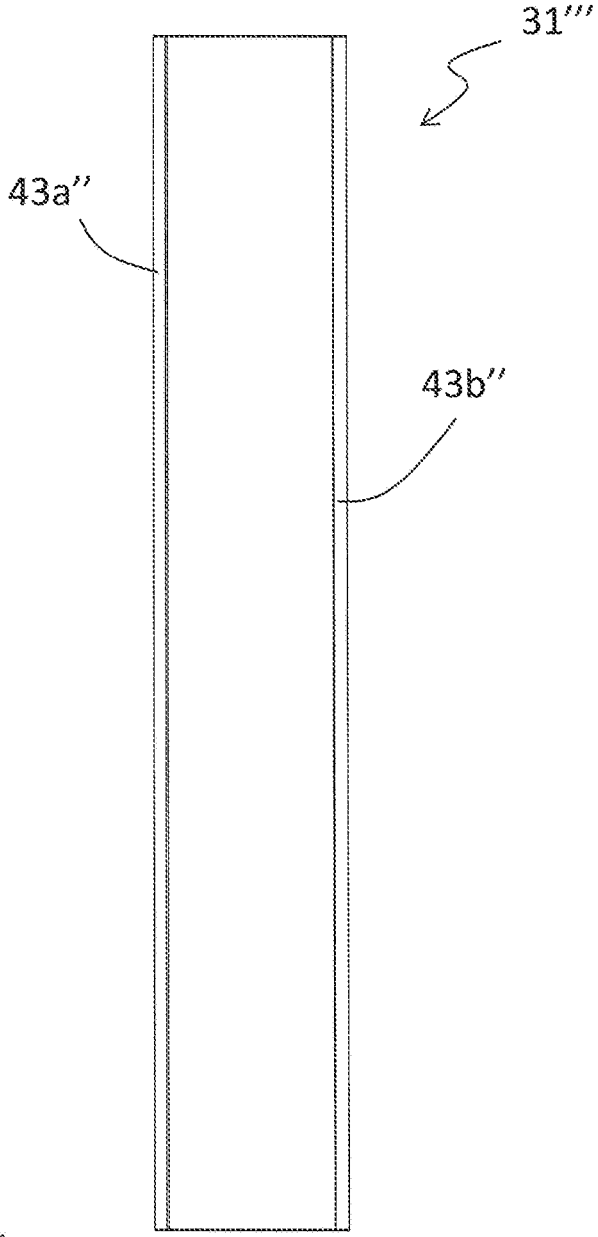

FIGS. 6*g* and 6*h* show a linking element 31'" according to another embodiment of the invention. FIG. 6*g* is a top view of the linking element 31'" and FIG. 6*h* is a front view of the linking element 31'". The design and function correspond to the previously described linking elements. Locking elements 43*a*", 43*b*" are in this embodiment provided as a 90 degree bend of the plate along each side of the linking element 31'".

Figure 6I:
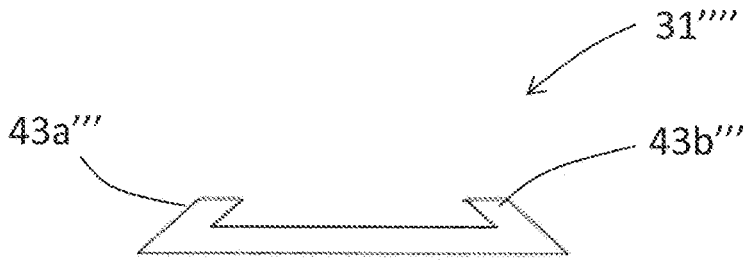
FIGS. 6*i* and 6*j* show a linking element according to another embodiment of the invention.
Figure 6J:
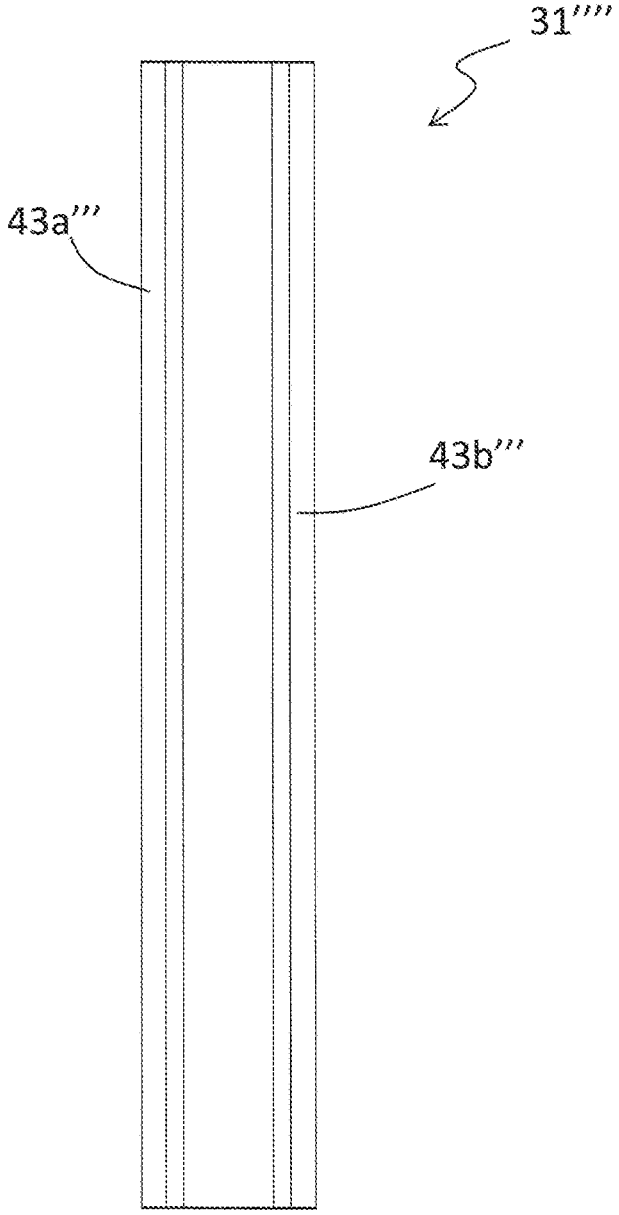

FIGS. 6*i* and 6*j* show a linking element 31"" according to another embodiment of the invention. FIG. 6*i* is a top view of the linking element 31' and FIG. 6*j* is a front view of the linking element 31". The design and function correspond to the previously described linking elements. Locking elements 43*a*'", 43*b*'" are in this embodiment provided as bends of more than 90 degrees along each side of the linking element 31".

Figure 7:
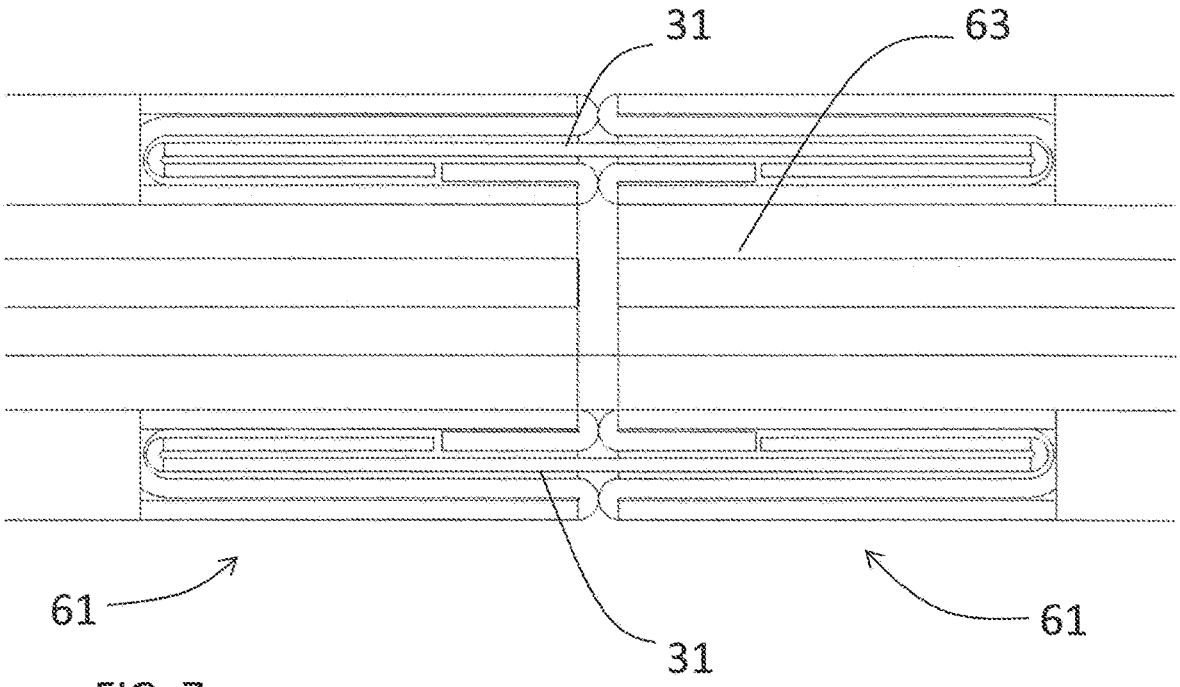
FIG. 7 is a cross section top view of two connected wall modules of sandwich type according to one embodiment of the invention.

FIG. 7 is a top view cross section of two connected wall modules 61 according to one embodiment of the invention. In this embodiment of the invention the wall modules 61 are of sandwich type, i.e. two wall modules 1 of the type described above in relation to FIGS. 1-5 are mounted together possibly with isolation 63 in between. When such a sandwich type wall module 61 should be mounted to another sandwich type wall module 61 either one or two linking elements 31 as described above in relation to FIGS. 6*a*-6*j* can be used. In FIG. 7 two linking elements 31 are used.

Figure 8:
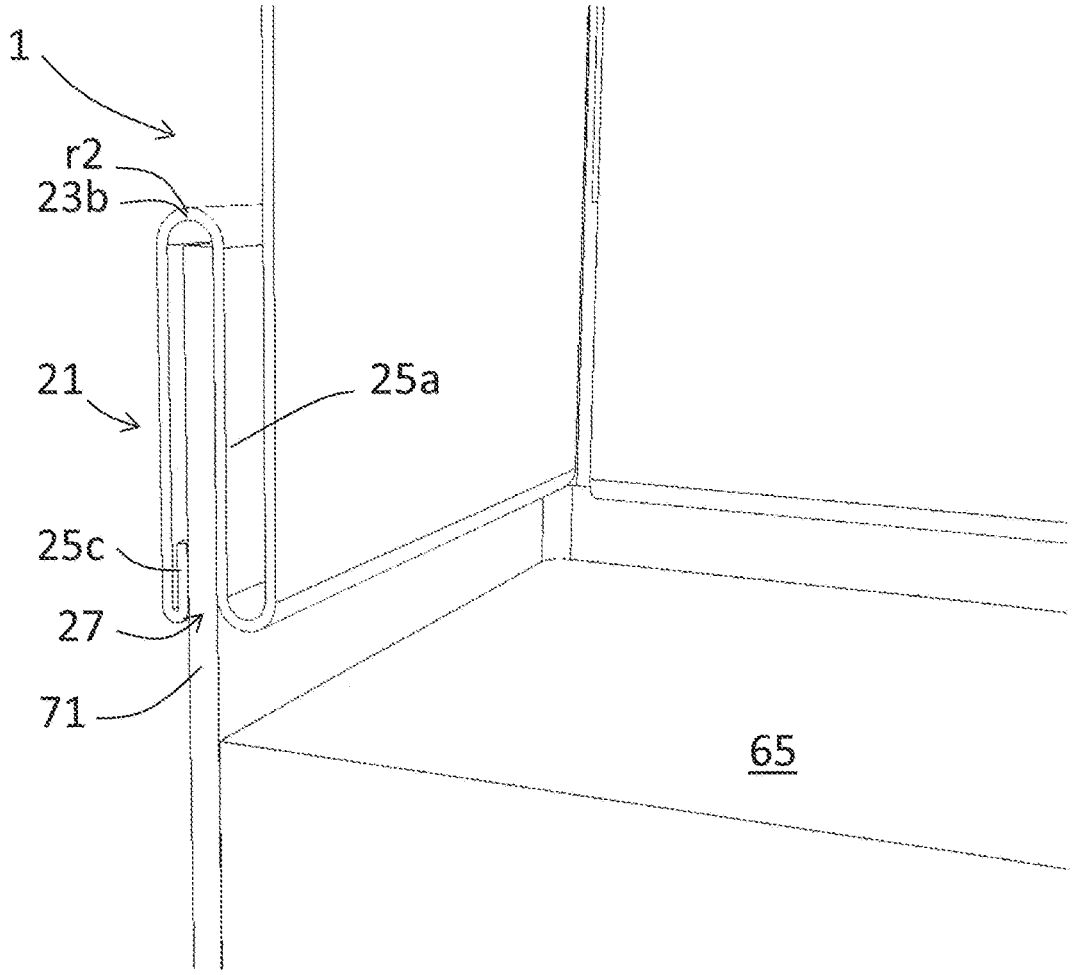
FIG. 8 is a cross section side view of a wall module according to one embodiment of the invention when the wall module is connected to a floor strip.

FIG. 8 is a cross section side view of a wall module 1 according to one embodiment of the invention when the wall module 1 is connected to a floor strip 71. The wall module 1 is the same as shown in the FIGS. 1-5. The floor strip 71 is a strip connected to a floor 65 normally in a right angle. If the wall module 1 should be part of a wall in for example a bath room where a water proof mounting of the wall is important the floor strip 71 is mounted to the floor in a water proof way or the floor strip may be an integral part of the floor 73. If the wall module 1 should be a part of a wall in another room where water resistance not is an issue the floor strip can be any kind of rail attached to the floor 73. In FIG. 8 it can be seen that the wall module 1 is mounted to the floor strip 71 by providing the floor strip into an opening 27 provided between the first bent bottom part 25*a* and the third bent bottom part 25*c* if a third bent bottom part 25*c* is provided. If only a first and a second bent bottom part 125*a*, 125*b* are provided as discussed above in relation to FIG. 4*b* the floor strip 71 is provided into the opening provided between the first and second bend bottom parts 125*a*, 125*b*. Hereby the radius r2 of the second bottom bend 23*b*; 123*b* should be provided such that the opening 27; 127 has a width which is about the same as a thickness of the floor strip 71. Furthermore a locking detail could be provided to the floor strip 71 at a suitable distance above the floor. No locking detail is shown in FIG. 8 but such a locking detail could be suitable for improving stability of the wall module mounting to the floor strip 71. Such a locking detail could be locked within the bottom bent configuration 21 inside the third bent bottom part 25*c* and could be provided as an inclined edge such that the third bent bottom part 25*c* can slide over it when the wall module 1 is mounted to the floor strip 71.

Figure 9:
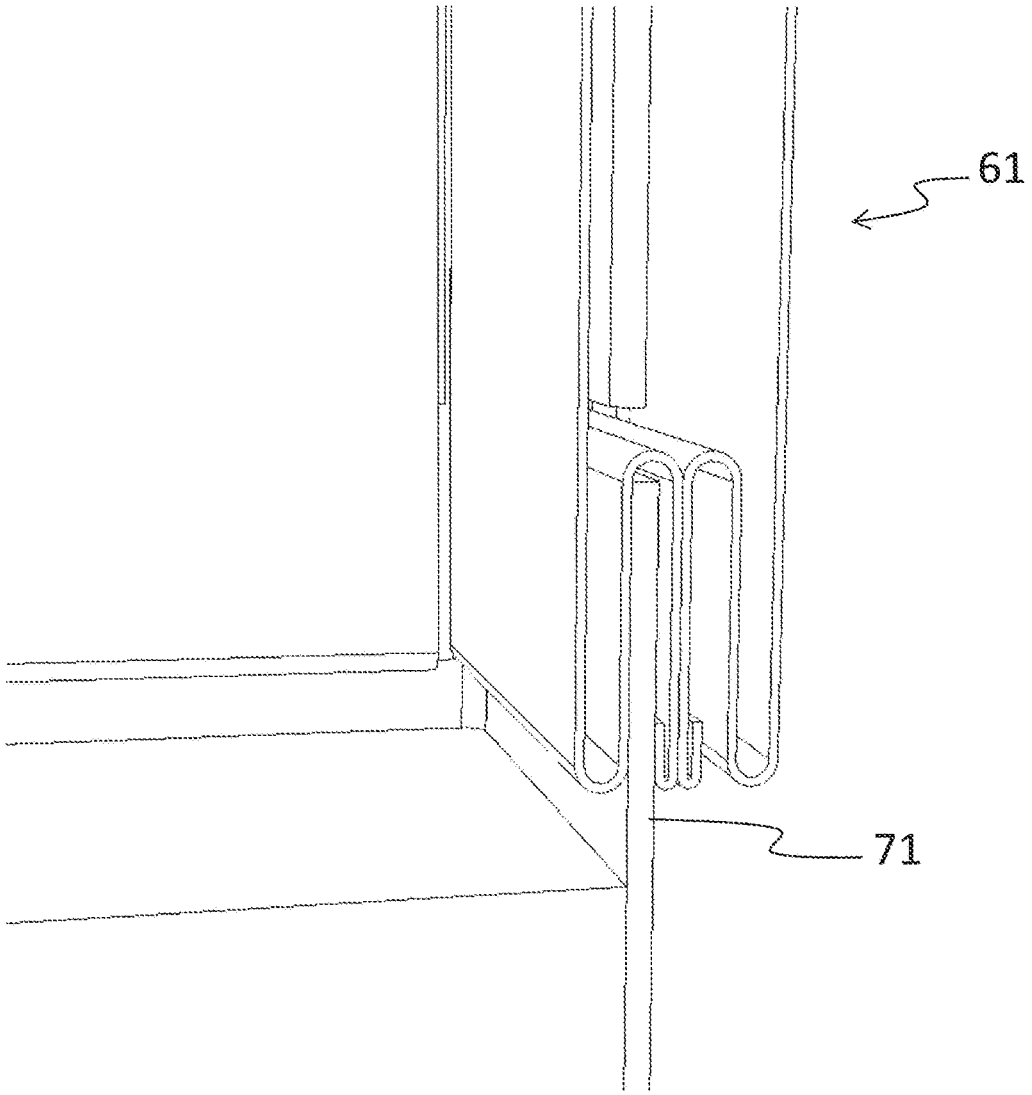
FIG. 9 is a cross section side view of a wall module of sandwich type according to one embodiment of the invention when the wall module is connected to a floor strip.

FIG. 9 is a cross section side view of a wall module 61 of sandwich type according to one embodiment of the invention when the wall module 61 is connected to a floor strip 71. The wall module is the same sandwich type as described in relation to FIG. 7. The mounting to the floor list 71 is the same as described for a single wall module 1 in relation to FIG. 8 and will not be described again.

Figure 10:
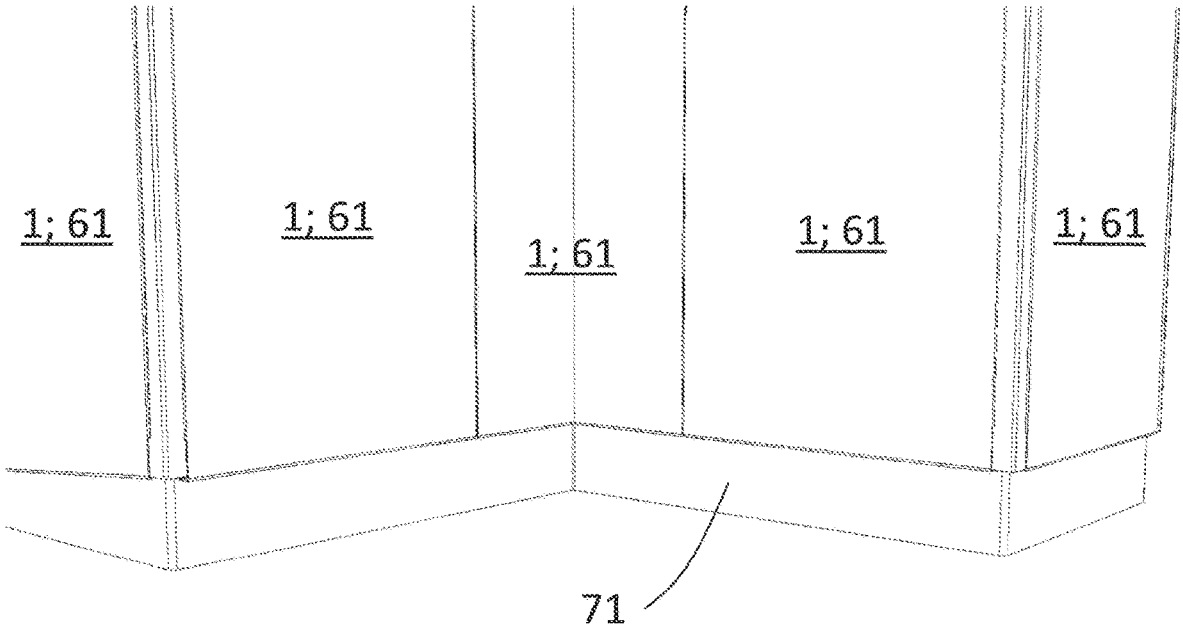
FIG. 10 shows five wall modules according to different embodiments of the invention connected to each other and to a floor strip.
Figure 11:
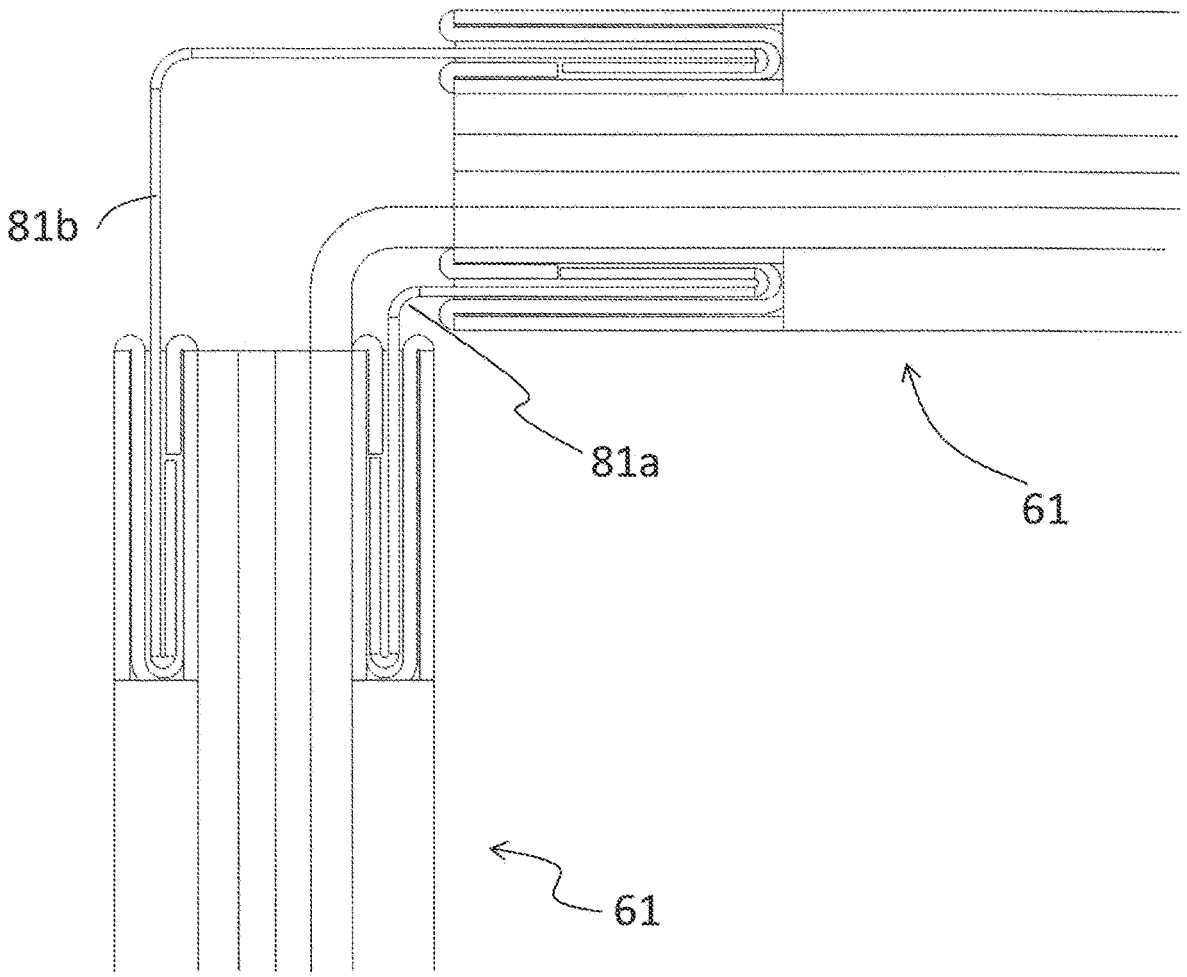
FIG. 11 is a cross section top view of two wall modules according to one embodiment of the invention connected to each other by a corner linking element according to one embodiment of the invention.

FIG. 10 shows five wall modules 1; 61 according to embodiments of the invention connected to each other and to a floor strip 71. When connecting wall modules according to the invention to each other around a corner as shown in FIG. 10 a corner linking element can be used. Such a corner linking element is shown in FIGS. 11 and 12. However another possibility is to bend the wall module itself. The middle corner of FIG. 10 is a bent wall module and is shown in further detail in FIG. 13. The two other corners in FIG. 10 use a corner linking element.

FIG. 11 is a cross section top view of two wall modules 61 of sandwich type as shown in FIG. 7 according to one embodiment of the invention when they are connected to each other by two corner linking elements 81*a*, 81*b* according to one embodiment of the invention. In the same way two single wall modules 1 as the ones described in relation to FIGS. 1-5 can be connected by one corner linking element 81.

Figure 12A:
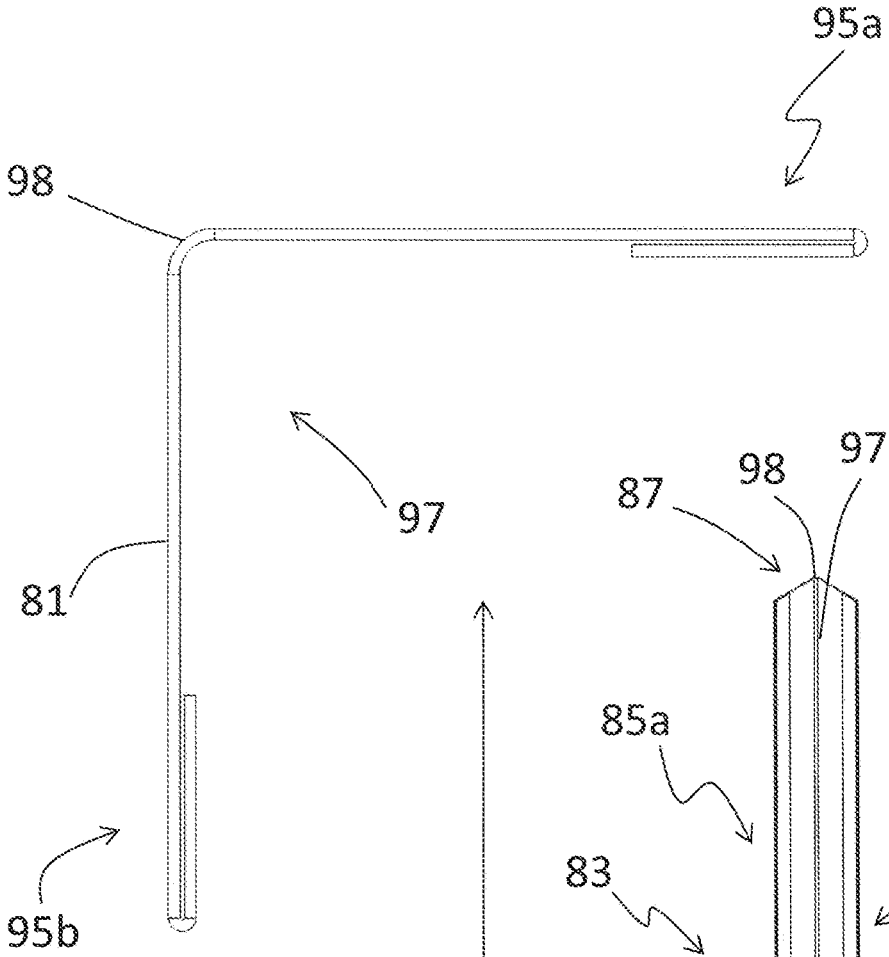
FIGS. 12*a* and 12*b* show schematically a corner linking element according to one embodiment of the invention.
Figure 12B:
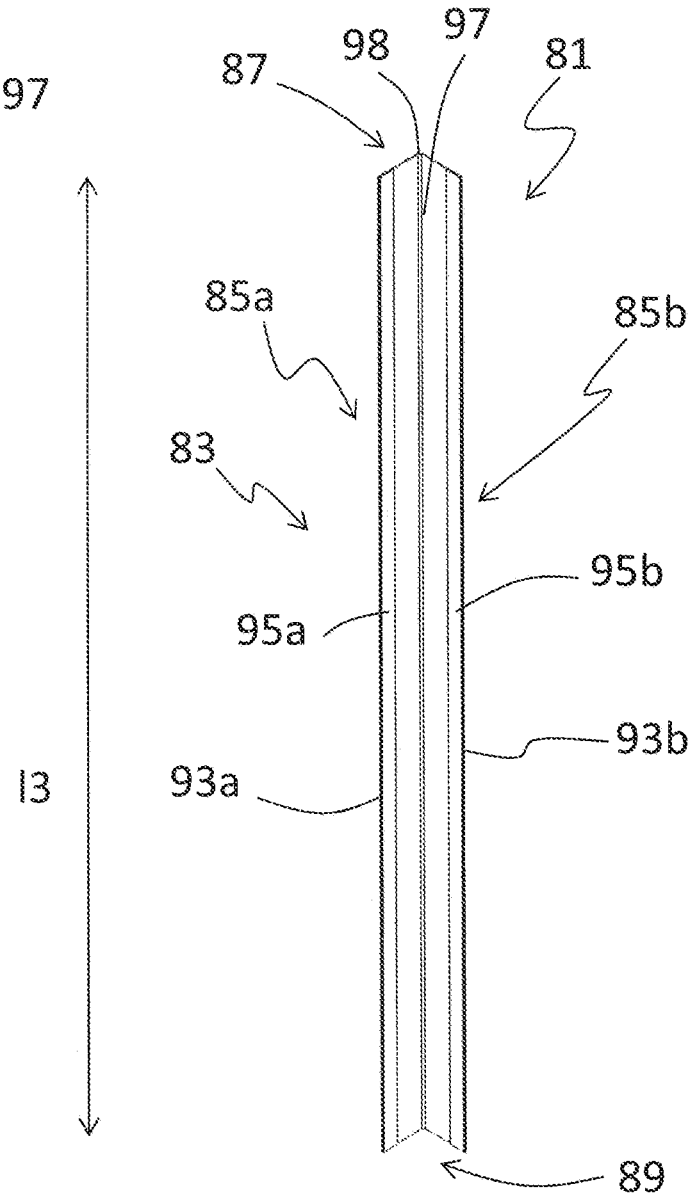

FIGS. 12*a* and 12*b* show schematically a corner linking element 81; 81*a*, 81*b* according to one embodiment of the invention. The difference between the two different corner linking elements 81*a*, 81*b* as used in FIG. 11 for connecting two sandwich type wall modules is only the length of the legs. Only one example is shown here in FIGS. 12*a* and 12*b* and is numbered as 81 but could as well be 81*a* or 81*b*. The corner linking element 81 comprises an elongated plate 83 having two corner linking element side edges 85*a*, 85*b*, one corner linking element top edge 87 and one corner linking element bottom edge 89. The corner linking element 81 comprises further a side edge bent 93*a*, 93*b* in each side edge 85*a*, 85*b* hereby providing two side parts 95*a*, 95*b* of the corner linking element 81 comprising double folded plate and a middle part 97 of the corner linking element 81 comprising a single layer of the plate. A length l3 of said corner linking element 81 corresponds substantially to a length l2 of the wall module 1 and the radius of the second side bend 13*b* of the wall module is provided such that a side part 95*a*, 95*b* of the corner linking element 81 can be provided into the opening 17 between the first and third bent side parts 15*a*, 15*c* of the wall module. During the connection of the wall module to the corner linking element 81 the side part 95*a*, 95*b* of the corner linking element 81 will be passing the third bent side part 15*c* which finally will lock a side part 95*a*, 95*b* of the corner linking element 81 within the side edge bent configuration 11 of the wall module 1 when a wall module and a corner linking element have been connected. The middle part 97 of the corner linking element 81 comprises a 90° bend 98.

Figure 13:
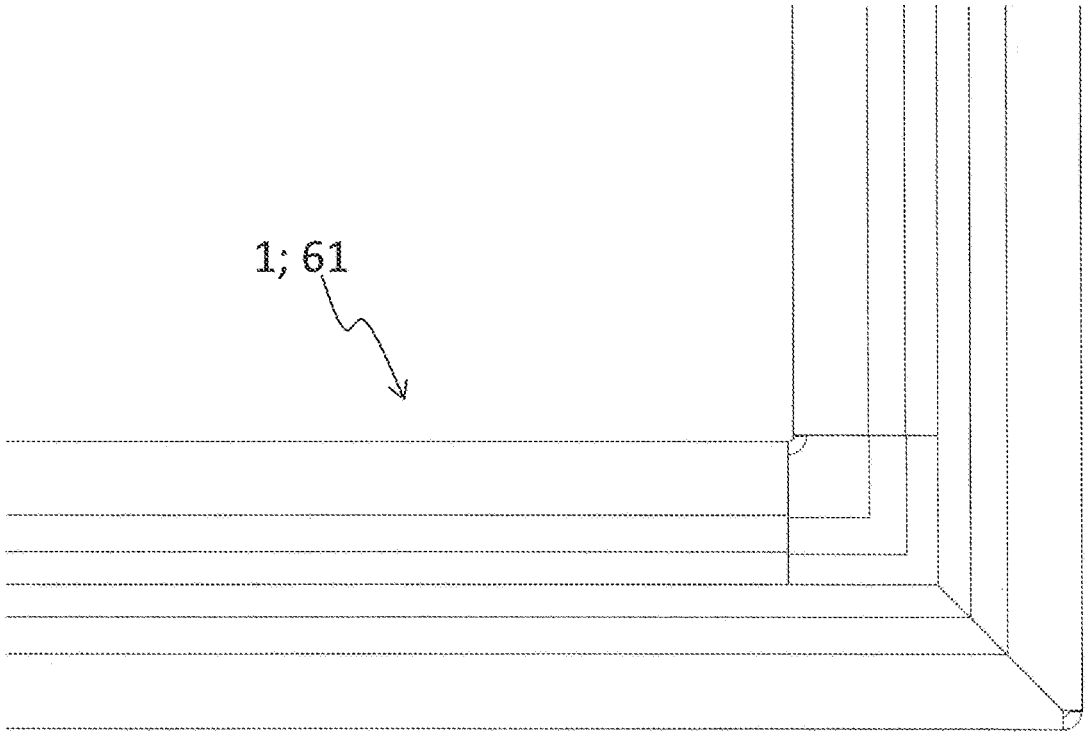
FIG. 13 shows an alternative corner of a wall module.

FIG. 13 shows the middle corner in FIG. 10. Hereby no corner linking element 81 is used. Instead the wall module 1; 61 has been bent.

The invention claimed is:

1. A wall system comprising at least one wall module (1) and at least one linking element (31; 31'; 31"; 31'"; 31""), wherein said wall module (1) comprises a substantially rectangular plate (3), said rectangular plate comprising two side edges (5*a*, 5*b*), one top edge (7) and one bottom edge (9), said side edges (5*a*, 5*b*) each comprising a side edge bent configuration (11), said side edge bent configuration comprises a first side bend (13*a*), a second side bend (13*b*) and a third side bend (13*c*), all three side bends (13*a,b,c*) are substantially 180° or 160-200° and are provided along different bending lines being parallel with the side edges (5*a*, 5*b*) of the plate, whereby the side edge bent configuration (11) comprises a first bent side part (15*a*) provided along the respective side edge (5*a*, 5*b*) of the plate (3) between the first side bend (13*a*) and the second side bend (13*b*), a second bent side part (15*b*) provided along the side edge of the plate between the second side bend (13*b*) and the third side bend (13*c*) and a third bent side part (15*c*) provided along the side edge of the plate between the third side bend (13*c*) and an open end side (16) or a fourth bent, side part of the plate (3), said first bent side part (15*a*) will be provided between the plate (3) and said second bent side part (15*b*) and wherein said third bent side part (15*c*) is provided in between said first and said second bent side parts (15*a*, 15*b*) and which third bent side part (15*c*) is smaller than both the first and the second bent side parts (15*a*, 15*b*), said linking element comprises an elongated rectangular plate (33; 33') comprising two side parts (45*a*, 45*b*: 45*a*', 45*b*') along a length of said plate (33; 33') and a middle part (47; 47') along the length of said plate between said two side parts, said two side parts (45*a*, 45*b*; 45*a*', 45*b*') comprises locking features (43*a*, 43*b*; 201; 43*a*', 43*b*'; 43*a*"; 43*b*"; 43*a*'"; 43*b*'"), and the radius of the second side bend (13*b*) of the wall module is provided such that a side part (45*a*, 45*b*; 45*a*', 45*b*') of the linking element (31; 31'; 31"; 31'"; 31"") can be provided into an opening (17) between the first and third bent side parts (15*a*, 15*c*) of the wall module and during the connection will be passing the third bent side part (15*c*) which finally will lock a side part (45*a*, 45*b*; 45*a*', 45*b*') of the linking element (31; 31'; 31"; 31'"; 31"") within the side edge bent configuration (11) of the wall module (1) when the wall module and the linking element have been connected, whereby a width (w1) of the middle part (47; 47') corresponds substantially to a width (w2) of the third bent side part (15*c*) of the wall module (1) times two.

2. Wall system according to claim 1, wherein a radius (r1) of the second side bend (13*b*) is provided such that an opening (17) into the side edge bent configuration (11) is provided between the first and third bent side parts (15*a*, 15*c*) for receiving the linking element.

3. Wall system according to claim 2, wherein said bottom edge (9) of said rectangular plate (3) comprises a bottom edge bent configuration (21; 121), said bottom edge bent configuration comprises a first bottom bend (23*a*; 123*a*) and a second bottom bend (23*b*; 123*b*), the first and second bottom bends (23*a,b*; 123*a,b*) are substantially 180° and are provided along different bending lines being parallel with the bottom edge (9) of the plate, whereby the bottom edge bent configuration (21; 121) comprises a first bent bottom part (25*a*; 125*a*) provided along the bottom edge (9) of the plate (3) between the first bottom bend (23*a*; 123*a*) and the second bottom bend (23*b*; 123*b*), a second bent bottom part (25*b*; 125*b*) provided along the bottom edge of the plate between the second bottom bend (23*b*, 123*b*) and either a third bottom bend (23*c*) or an open bottom end side (26; 126) of the panel, and the first bent bottom part (25*a*; 125*a*) will be provided between the plate (3) and the second bent bottom part (25*b*; 125*b*).

4. Wall system according to claim 3, wherein a radius (r2) of the second bottom bend (23*b*; 123*b*) is provided such that an opening (27) into the bottom edge bent configuration (21) is provided between the first and second bent bottom parts (25*a*, 25*b*; 125*a*, 125*b*) for receiving a floor strip.

5. Wall system according to claim 4, wherein said bottom edge bent configuration (21) comprises also a third bottom bend (23*c*) being substantially 180° and being provided along a bending line which is parallel with the bottom edge (9) of the plate and hereby said bottom edge bent configuration (21) further comprises a third bent bottom part (25*c*) provided along the bottom edge of the plate between the third bottom bend (23*c*) and an open bottom end side (26) of the panel, which third bent bottom part (25*c*) being provided in between said first and said second bent bottom parts (25*a*, 25*b*) and which third bent bottom part (25*c*) is smaller than both the first and the second bent bottom parts (25*a*, 25*b*).

6. Wall system according to claim 5, wherein a radius (r3) of the first bottom bend (23*a*; 123*a*) is provided such that the first, second and third bend side parts (15*a*, 15*b*, 15*c*) of the side edges (5*a*, 5*b*) are provided in between a plane in which the first bent bottom part (25*a*; 125*a*) is provided and a plane in which a center part of the plate (3) is provided.

7. Wall system according to claim 3, wherein said bottom edge bent configuration (21) comprises also a third bottom bend (23*c*) being substantially 180° and being provided along a bending line which is parallel with the bottom edge (9) of the plate and hereby said bottom edge bent configuration (21) further comprises a third bent bottom part (25*c*) provided along the bottom edge of the plate between the third bottom bend (23*c*) and an open bottom end side (26) of the panel, which third bent bottom part (25*c*) being provided in between said first and said second bent bottom parts (25*a*, 25*b*) and which third bent bottom part (25*c*) is smaller than both the first and the second bent bottom parts (25*a*, 25*b*).

8. Wall system according to claim 7, wherein a radius (r3) of the first bottom bend (23*a*; 123*a*) is provided such that the first, second and third bend side parts (15*a*, 15*b*, 15*c*) of the side edges (5*a*, 5*b*) are provided in between a plane in which the first bent bottom part (25*a*; 125*a*) is provided and a plane in which a center part of the plate (3) is provided.

9. Wall system according to claim 1, wherein the material of the rectangular plate is sheet metal.

10. Wall system according to claim 1, wherein said locking features (43*a*, 43*b*; 201; 43*a*', 43*b*'; 43*a*"; 43*b*"; 43*a*'"; 43*b*'") extend from a plane of the elongated rectangular plate (33; 33') of the linking element (31; 31'; 31"; 31'"; 31""), which locking features will be locked inside the side edge bent configuration (11) by the third bent side part (15*c*) when the wall module and the linking element have been connected.

11. Wall system according to claim 1, wherein a length (l1) of said linking element (31; 31'; 31"; 31'"; 31"") corresponds substantially to a length (l2) of the wall module (1).

12. Wall system according to claim 1, wherein said locking features (43*a*, 43*b*) are double folds of the plate (33) along its side edges (35*a*, 35*b*) hereby providing two side parts (45*a*, 45*b*) of the linking element (31) comprising double folded plate and a middle part (47) of the linking element (31) comprising a single layer of the plate.

13. Wall system according to claim 1, wherein the wall system further comprises a corner linking element (81), said corner linking element comprising an elongated plate (83) having two corner linking element side edges (85*a*, 85*b*), one corner linking element top edge (87) and one corner linking element bottom edge (89), said corner linking element (81) further comprising a side edge bent (93*a*, 93*b*) in each side edge 85*a*, 85*b*) hereby providing two side parts (95*a*, 95*b*) of the corner linking element (81) comprising double folded plate and a middle part (97) of the corner linking element (81) comprising a single layer of the plate, and a length (l3) of said corner linking element (81) corresponds substantially to a length (12) of the wall module (1) and wherein the radius of the second side bend (13*b*) of the wall module is provided such that a side part (95*a*, 95*b*) of the corner linking element (81) can be provided into the opening between the first and second bent side parts (15*a*, 15*b*) of the wall module and during the connection will be passing the third bent side part (15*c*) which finally will lock a side part (95*a*, 95*b*) of the corner linking element (81) within the wall module when a wall module and a corner linking element have been connected, whereby said middle part (97) of the corner linking element comprises a substantially 90° bend (98).

14. A wall segment comprising a wall system according to claim 1, comprising at least two said wall modules and said at least one linking element (31; 31') linking the two wall modules together.

15. A wall system comprising at least one wall module (1) and at least one linking element (31; 31'; 31"; 31'''; 31''''), wherein said wall module (1) comprises a substantially rectangular plate (3), said rectangular plate comprising two side edges (5*a*, 5*b*), one top edge (7) and one bottom edge (9), said side edges (5*a*, 5*b*) each comprising a side edge bent configuration (11), said side edge bent configuration comprises a first side bend (13*a*), a second side bend (13*b*) and a third side bend (13*c*), all three side bends (13*a,b,c*) are substantially 180° or 160-200° and are provided along different bending lines being parallel with the side edges (5*a*, 5*b*) of the plate, whereby the side edge bent configuration (11) comprises a first bent side part (15*a*) provided along the respective side edge (5*a*, 5*b*) of the plate (3) between the first side bend (13*a*) and the second side bend (13*b*), a second bent side part (15*b*) provided along the side edge of the plate between the second side bend (13*b*) and the third side bend (13*c*) and a third bent side part (15*c*) provided along the side edge of the plate between the third side bend (13c) and an open end side (16) or a fourth bent side part of the plate (3), said first bent side part (15*a*) will be provided between the plate (3) and said second bent side part (15*b*) and wherein said third bent side part (15*c*) is provided in between said first and said second bent side parts (15*a*, 15*b*) and which third bent side part (15*c*) is smaller than both the first and the second bent side parts (15*a*, 15*b*), said linking element comprises an elongated rectangular plate (33; 33') comprising two side parts (45*a*, 45*b*: 45*a*', 45*b*') along a length of said plate (33; 33') and a middle part (47; 47') along the length of said plate between said two side parts, said two side parts (45*a*, 45*b*; 45*a*', 45*b*') comprises locking features (43*a*, 43*b*; 201; 43*a*', 43*b*'; 43*a*"; 43*b*"; 43*a*"; 43*b*"), the radius of the second side bend (13*b*) of the wall module is provided such that a side part (45*a*, 45*b*; 45*a*', 45*b*') of the linking element (31; 31'; 31"; 31'''; 31'''') can be provided into an opening (17) between the first and third bent side parts (15*a*, 15*c*) of the wall module and during the connection will be passing the third bent side part (15*c*) which finally will lock a side part (45*a*, 45*b*; 45*a*', 45*b*') of the linking element (31; 31'; 31"; 31'''; 31'''') within the side edge bent configuration (11) of the wall module (1) when the wall module and the linking element have been connected, said bottom edge (9) of said rectangular plate (3) comprises a bottom edge bent configuration (21; 121), said bottom edge bent configuration comprises a first bottom bend (23*a*; 123*a*) and a second bottom bend (23*b*; 123*b*), the first and second bottom bends (23*a,b*; 123*a,b*) are substantially 180° and are provided along different bending lines being parallel with the bottom edge (9) of the plate, whereby the bottom edge bent configuration (21; 121) comprises a first bent bottom part (25*a*; 125*a*) provided along the bottom edge (9) of the plate (3) between the first bottom bend (23*a*; 123*a*) and the second bottom bend (23*b*; 123*b*), a second bent bottom part (25*b*; 125*b*) provided along the bottom edge of the plate between the second bottom bend (23*b*, 123*b*) and either a third bottom bend (23*c*) or an open bottom end side (26; 126) of the panel, and the first bent bottom part (25*a*; 125*a*) will be provided between the plate (3) and the second bent bottom part (25*b*; 125*b*).

16. Wall system according to claim 15, wherein a radius (r2) of the second bottom bend (23*b*; 123*b*) is provided such that an opening (27) into the bottom edge bent configuration (21) is provided between the first and second bent bottom parts (25*a*, 25*b*; 125*a*, 125*b*) for receiving a floor strip.

17. Wall system according to claim 16, wherein said bottom edge bent configuration (21) comprises also a third bottom bend (23*c*) being substantially 180° and being provided along a bending line which is parallel with the bottom edge (9) of the plate and hereby said bottom edge bent configuration (21) further comprises a third bent bottom part (25*c*) provided along the bottom edge of the plate between the third bottom bend (23*c*) and an open bottom end side (26) of the panel, which third bent bottom part (25*c*) being provided in between said first and said second bent bottom parts (25*a*, 25*b*) and which third bent bottom part (25*c*) is smaller than both the first and the second bent bottom parts (25*a*, 25*b*).

18. Wall system according to claim 15, wherein said bottom edge bent configuration (21) comprises also a third bottom bend (23*c*) being substantially 180° and being provided along a bending line which is parallel with the bottom edge (9) of the plate and hereby said bottom edge bent configuration (21) further comprises a third bent bottom part (25*c*) provided along the bottom edge of the plate between the third bottom bend (23*c*) and an open bottom end side (26) of the panel, which third bent bottom part (25*c*) being provided in between said first and said second bent bottom parts (25*a*, 25*b*) and which third bent bottom part (25*c*) is smaller than both the first and the second bent bottom parts (25*a*, 25*b*).

19. Wall system according to claim 15, wherein a radius (r3) of the first bottom bend (23*a*; 123*a*) is provided such that the first, second and third bend side parts (15*a*, 15*b*, 15*c*) of the side edges (5*a*, 5*b*) are provided in between a plane in which the first bent bottom part (25*a*; 125*a*) is provided and a plane in which a center part of the plate (3) is provided.

* * * * *